US007155761B2

(12) United States Patent
DeRose

(10) Patent No.: US 7,155,761 B2
(45) Date of Patent: Jan. 2, 2007

(54) INTERCHANGEABLE FURNITURE SYSTEM

(75) Inventor: James DeRose, Belden, MS (US)

(73) Assignee: Lane Furniture Industries, Inc., Tupelo, MS (US)

( * ) Notice: Subject to any disclaimer, the term of this patent is extended or adjusted under 35 U.S.C. 154(b) by 143 days.

(21) Appl. No.: 10/382,098

(22) Filed: Mar. 6, 2003

(65) Prior Publication Data

US 2004/0237190 A1 Dec. 2, 2004

Related U.S. Application Data

(60) Provisional application No. 60/418,172, filed on Oct. 15, 2002.

(51) Int. Cl.
*A47C 23/00* (2006.01)

(52) U.S. Cl. ..... 5/280; 5/285; 5/907

(58) Field of Classification Search ..... 5/285, 5/280, 53.1, 907; 312/265.6, 348.4, 384.6, 312/204; 40/320, 606.08
See application file for complete search history.

(56) References Cited

U.S. PATENT DOCUMENTS 3,408,127 A * 10/1968 Vincens ..... 312/194
6,543,071 B1 * 4/2003 Lenner ..... 5/280
6,658,677 B1 * 12/2003 Paul ..... 5/280

* cited by examiner

*Primary Examiner*—Patricia Engle
*Assistant Examiner*—Fredrick Conley
(74) *Attorney, Agent, or Firm*—Sutherland Asbill & Brennan LLP

(57) ABSTRACT

An interchangeable furniture system for providing an interchangeable furniture element having faces with different appearances. The desired face may be selected and the interchangeable furniture element selectively oriented to make that face visible.

11 Claims, 7 Drawing Sheets

INTERCHANGEABLE FURNITURE SYSTEM

CROSS-REFERENCE TO RELATED APPLICATIONS

This application claims priority to U.S. Provisional Application No. 60/418,172, filed on Oct. 15, 2002. The entire contents of that application are incorporated by reference herein.

BACKGROUND OF THE INVENTION

1. Field of the Invention

The present invention relates generally to furniture, and, more particularly to an interchangeable furniture system that may be used to change the structure and appearance of a furniture item.

2. General Background

Furniture products for domestic and commercial use, which frequently are costly items, often cannot easily have their structure and appearance modified for aesthetic or other purposes. Fine furniture is often finished with a wood stain and protective finish on its outer surfaces and refinishing of such furniture is prohibitively expensive, time consuming, and complicated. Painting of such an item to change its appearance is often not desirable and can impair its value. Installation of functional items, such as shelving or racks, may mar the appearance of the furniture product.

Likewise, covering components of a furniture item with fabric or leather to change appearance is also expensive and particularly difficult where the item must be disassembled to accomplish this task. For example, providing a fabric or leather covered section for a wooden headboard of a bed frame produces a pleasing appearance that significantly changes the overall aesthetic impression of the headboard, but modifying a wooden headboard to cover it with fabric is quite difficult and expensive. Accordingly, there is a need for an interchangeable furniture element that can be readily and easily interchanged to provide a different appearance or function for a furniture product, while maintaining the structural integrity of the furniture piece.

BRIEF DESCRIPTION OF THE DRAWINGS

The benefits of the present invention will be readily appreciated and understood from consideration of the following description of the accompanying drawings, in which.

DETAILED DESCRIPTION

While the present invention will hereinafter be described in connection with exemplary embodiments thereof, it will understood that it is not intended to limit the invention to those embodiments. On the contrary, it is intended to cover all alternatives, modifications and equivalents as may be included within the spirit and scope of the invention as defined by the claims thereto.

Figure 1:
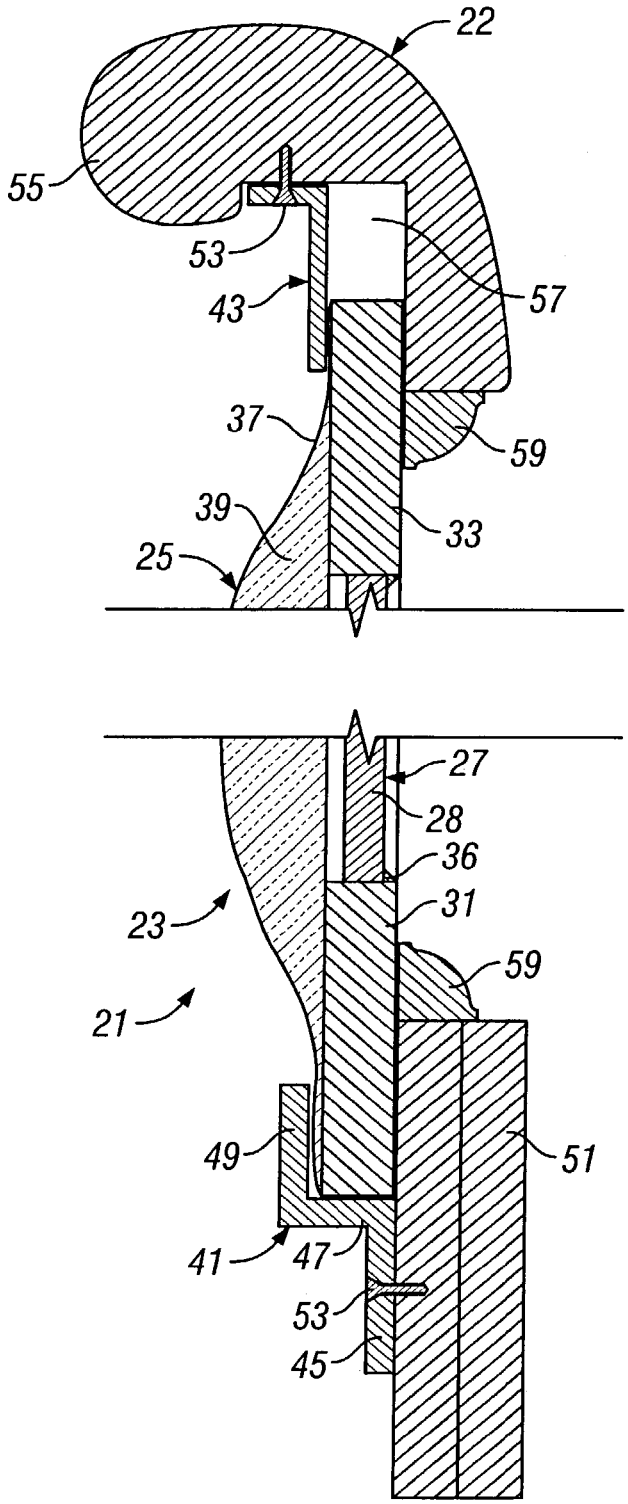
FIG. 1 is a sectional view of an embodiment of an interchangeable furniture system according to the present invention invention as utilized to provide an interchangeable element in the headboard of a bed, with the finished wood panel face of the interchangeable element oriented toward the front of the headboard.

Referring to FIG. 1, an embodiment of an interchangeable furniture system 21 for a headboard 22 of a bed is illustrated. The interchangeable furniture system 21 includes an interchangeable furniture element 23 having an upholstered fabric face 25 and a finished wood panel face 27. The interchangeable furniture element 23 also includes lower frame rail 31, upper frame rail 33, and two frame uprights 35 (one of the frame uprights 35 is visible in the view of FIG. 5). The frame rails 31, 33 and frame uprights 35 can be constructed of wood or other appropriate material. It should be recognized that the interchangeable furniture element can have any shape—circular polygonal, or otherwise, and is not limited to the embodiment shown herein.

The upholstered fabric face 25 includes a fabric portion 37 that is supported in the desired shape by batting 39 or other appropriate arrangement.

The finished wood panel face 27 includes finished panel 28, which may be finished with a wood stain or other appropriate treatment, such as painting. Molding 36 is installed at the juncture of finished panel 28 and the frame members 31, 33, 35.

The interchangeable furniture element 23 is supported by metal channels 41 at its lower end and angle iron 43 at its upper end. Each metal channel 41 has, in the illustrated embodiment, a generally Z-shaped section, and includes a lower flange 45, a web 47, and an upper flange 49. Alternatively, channels 41 could be constructed from two angle iron members, or could be formed from other appropriate channel shapes, as will be described presently. In the preferred embodiment, the channels 41 are attached to a mattress rail 51 through the use of threaded fasteners 53, or other appropriate arrangement. Channels 41 and angle iron 43 may be constructed from steel, aluminum, or other metal, or from plastic, wood or other appropriate material.

Figure 5:
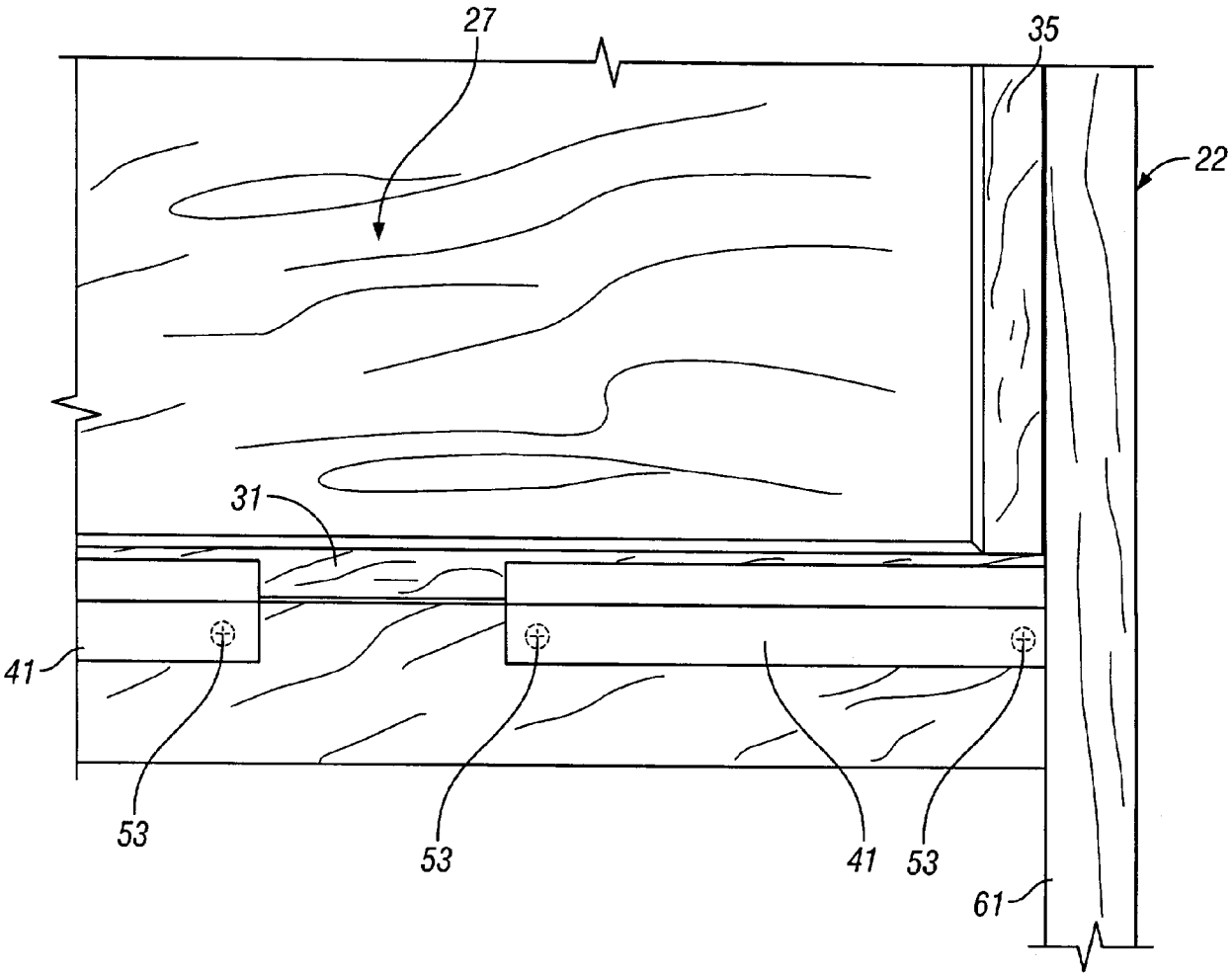
FIG. 5 is an elevational view of a portion of the rear of a headboard of FIG. 1, showing the spaced lower mounting channels of the invention supporting the interchangeable element.

Typically, at least two channels 41 would be provided, with each of the channels 41 being spaced from the other so as to provide an opening through which a user may grasp the lower frame rail 31 of the interchangeable furniture element 23, for purposes of removing the furniture element 23 for interchanging, as will be described presently. The spacing of the channels 41 is illustrated in FIG. 5.

Angle iron 43 is attached to a cap rail 55 of the headboard 22 by threaded fasteners 53, or other appropriate arrangement. The angle iron 43 is spaced from the cap rail 55 so as to provide sufficient clearance for the upper frame rail 33 of the interchangeable furniture element 23, and the cap rail 55 and the angle iron 43 are oriented so as to provide a clearance space 57 above the upper frame rail 33 in its installed position. The clearance space 57 is dimensioned so that a user can grasp the interchangeable furniture element 23 at the lower frame rail 31 and move the interchangeable frame element 23 upwardly so that the upper frame rail 33 enters the clearance space 57.

Figure 2:
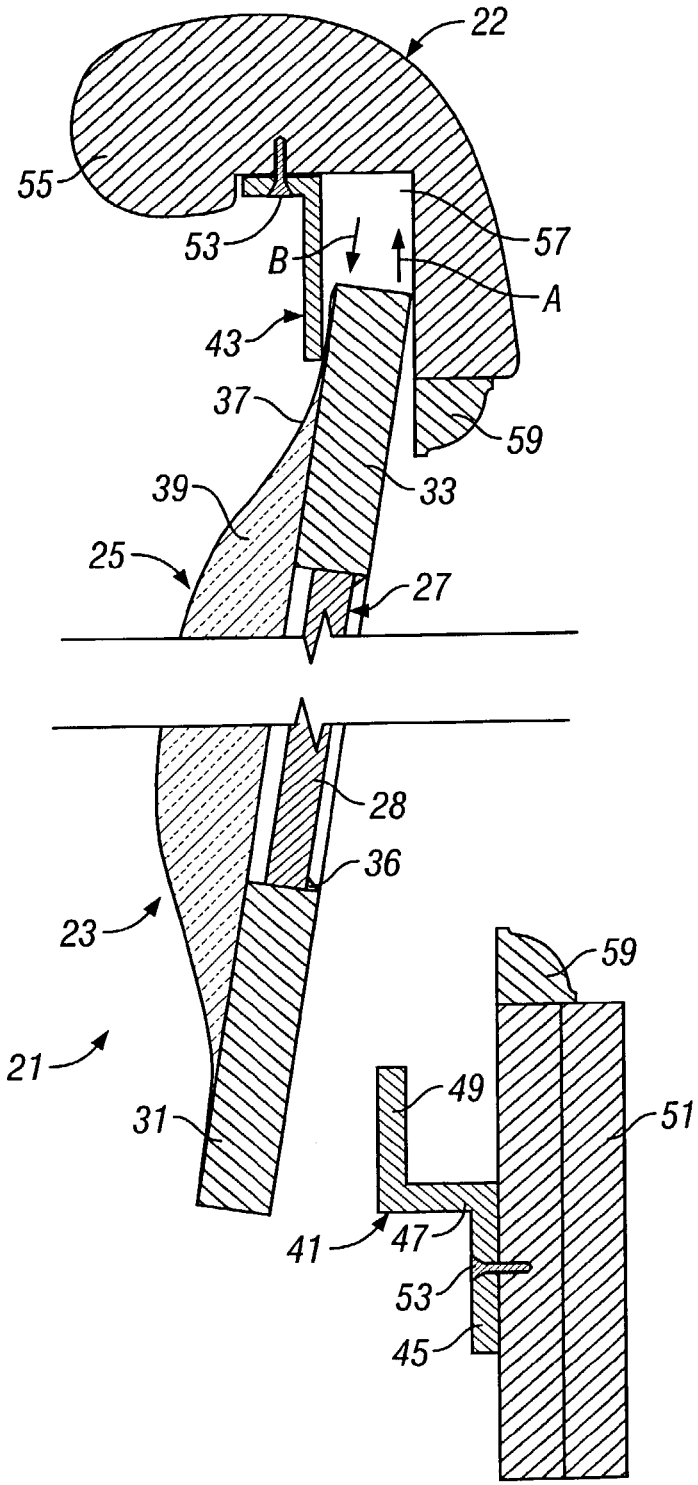
FIG. 2 is a sectional view of the embodiment of FIG. 1 showing the interchangeable element as it appears during removal from the headboard of the bed.
Figure 3:
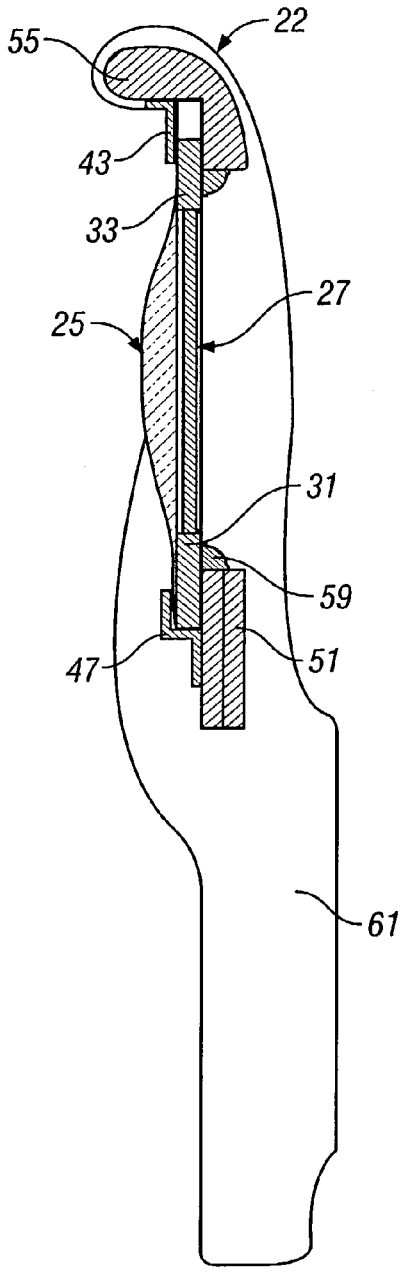
FIG. 3 is a schematic sectional view of the embodiment of FIG. 1, shown with the full length of the post of the headboard.

The user can then swing the lower frame rail 31 outwardly from the channels 41, as illustrated in FIG. 2, and then remove the interchangeable frame element for reversing or interchanging. Arrows A and B in clearance space 57 on FIG. 2 illustrate the sequence of movements of the upper frame rail 33 during removal: first upward (Arrow A), then downward along an angled path (Arrow B).

Channels 41 are dimensioned so as to provide sufficient clearance for the lower frame rail 31 to move vertically in the space between the upper flange 49 and the mattress rail 51, but not to permit excessive lateral movement of the lower rail 31.

In the illustrated embodiments, quarter round molding 59 is attached to the mattress rail 51, cap rail 55, and headboard posts 61 to provide a visual transition from the recessed interchangeable furniture element 23 and the mattress rail 51, cap rail 55, and headboard posts 61.

Figure 4:
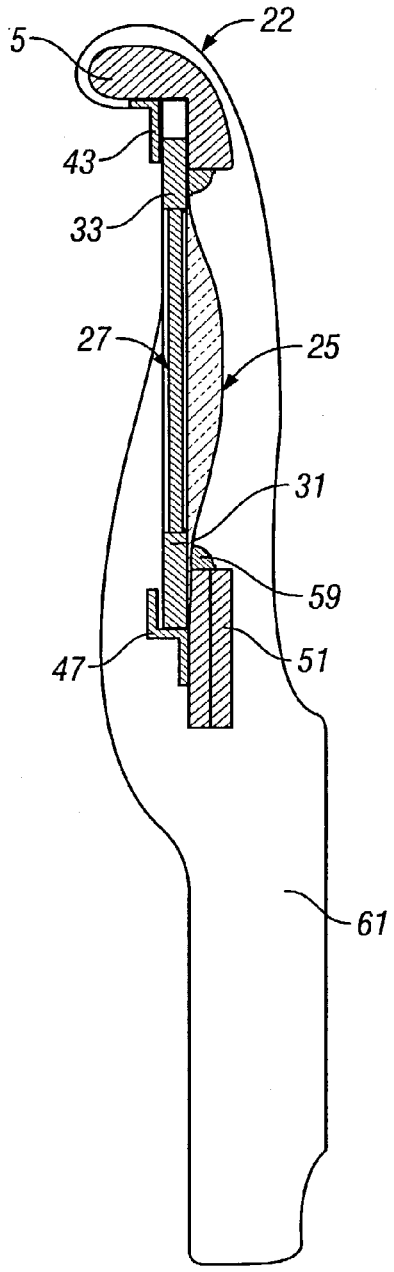
FIG. 4 is a schematic sectional view of the embodiment of FIG. 1 with the upholstered portion of the interchangeable furniture element oriented toward the front of the headboard.
Figure 7:
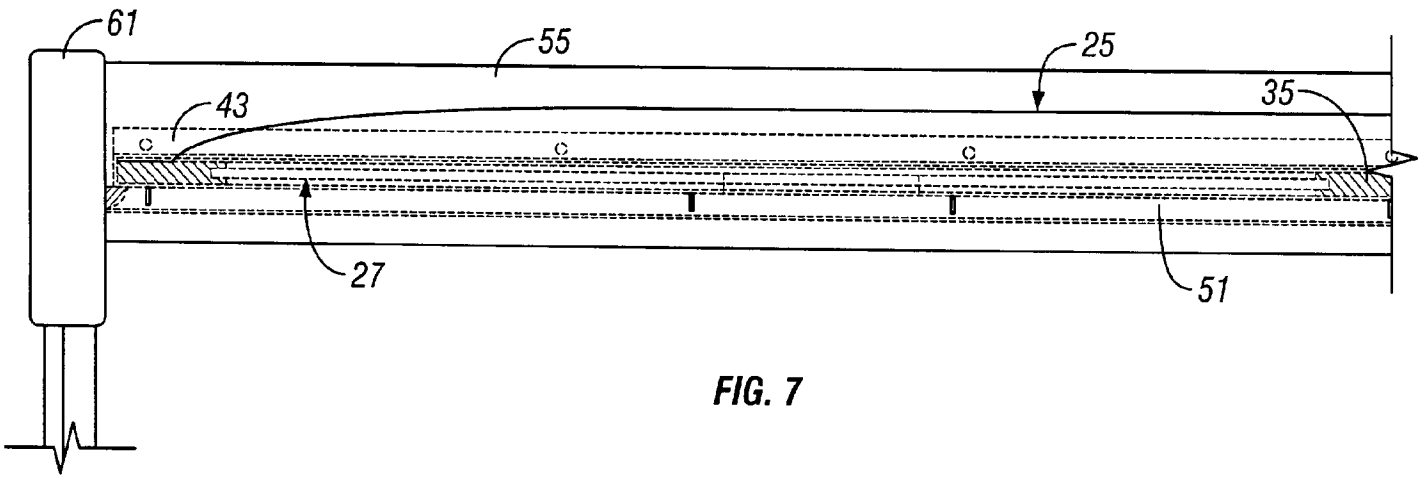
FIG. 7 is a plan view of the headboard of of FIG. 1 with the finished panel face of the interchangeable element oriented toward the front of the headboard.
Figure 8:
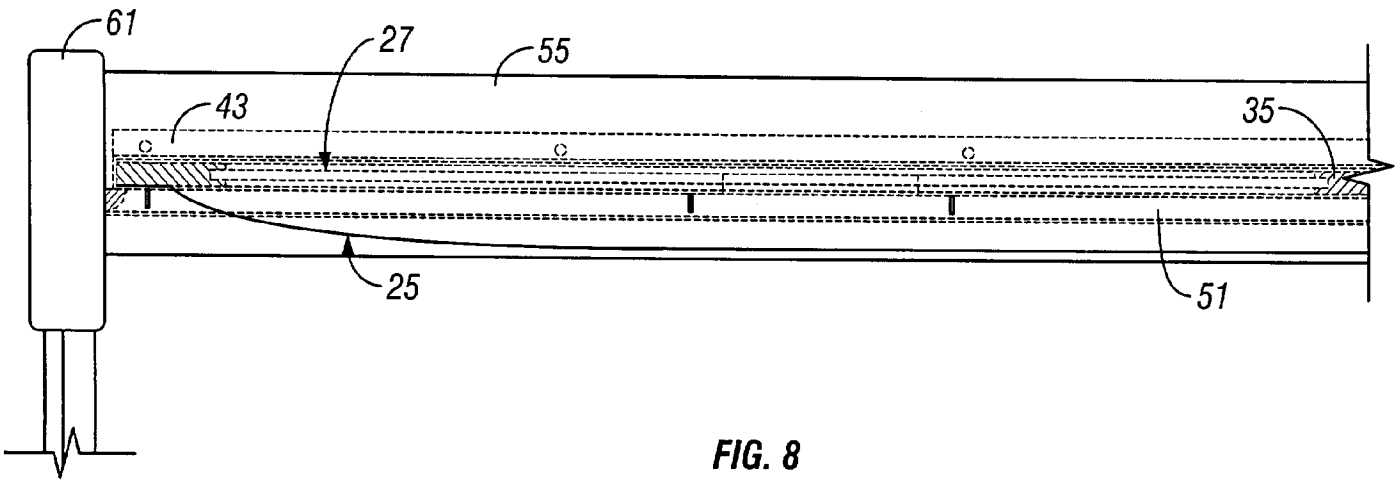
FIG. 8 is plan view of the headboard of FIG. 1 with the upholstered face of the interchangeable element oriented toward the front of the headboard.

The interchangeable furniture element 23 may be reversed to present a different face (as in FIGS. 3–4 and FIGS. 7–8). By removing the interchangeable furniture element 23, as shown in FIG. 2, the upholstered fabric face of the preferred embodiment can be positioned so as to face forward, as shown in FIGS. 4 and 8. In addition to being reversed so as to present a different face forward to change the appearance of the headboard 22, the interchangeable furniture element 23 can be exchanged entirely for a different interchangeable furniture element having other surface treatments to present different appearances. The faces of the interchangeable furniture element 23 can be finished, painted, inlaid, upholstered with different arrangements, provided with sculpture elements such as plaster or other bas relief, or any other treatment as desired.

Removal of the interchangeable furniture element 23 also facilitates modification of its faces. For example, the fabric portion 37 of the upholstered face 25 can be changed, and batting 39 can be removed or modified in shape and profile.

Figure 6:
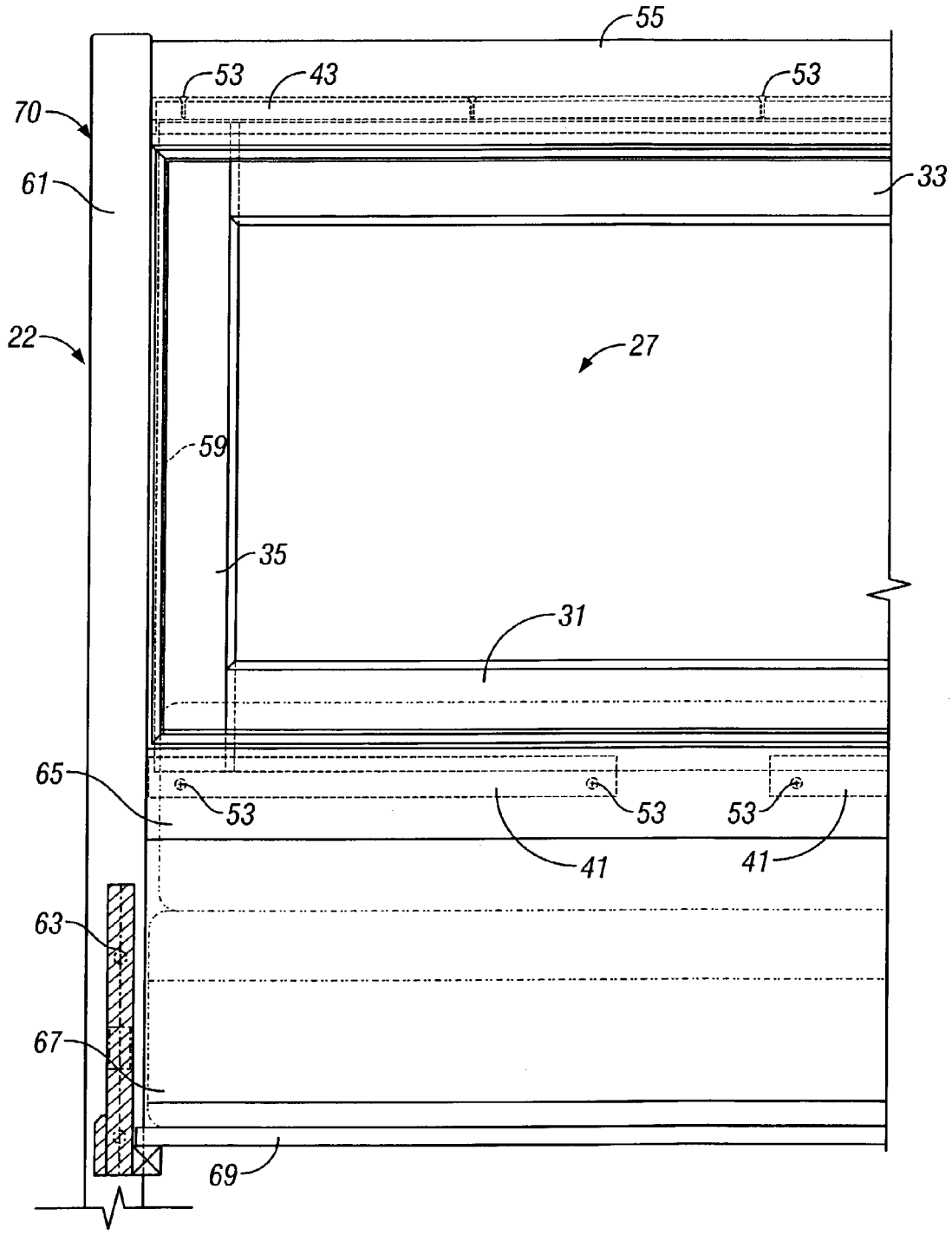
FIG. 6 is a front elevational view of a portion of the headboard of FIG. 1.

The interchangeable furniture system 21 of the present invention is shown in a front elevation view in FIG. 6, with the finished wood panel face 27 facing forward. The relative positions of the headboard 22 and the bed rails 63, mattress 65, box springs 67, and supporting cross members 69 of the bed can be seen. As shown in part in FIG. 6 the headboard posts 61, mattress rail 51, and cap rail 55 form a frame 70 that defines an opening that is spanned by either the upholstered fabric face 25 or the wood panel face 25, depending on how the interchangeable element 23 is installed.

In FIGS. 7 and 8, the interchangeable furniture system 21 of the present invention is shown in plan view with, respectively, the panel frame face 27 oriented forward (FIG. 7), and the upholstered fabric face 25 oriented forward (FIG. 8).

Figure 9:
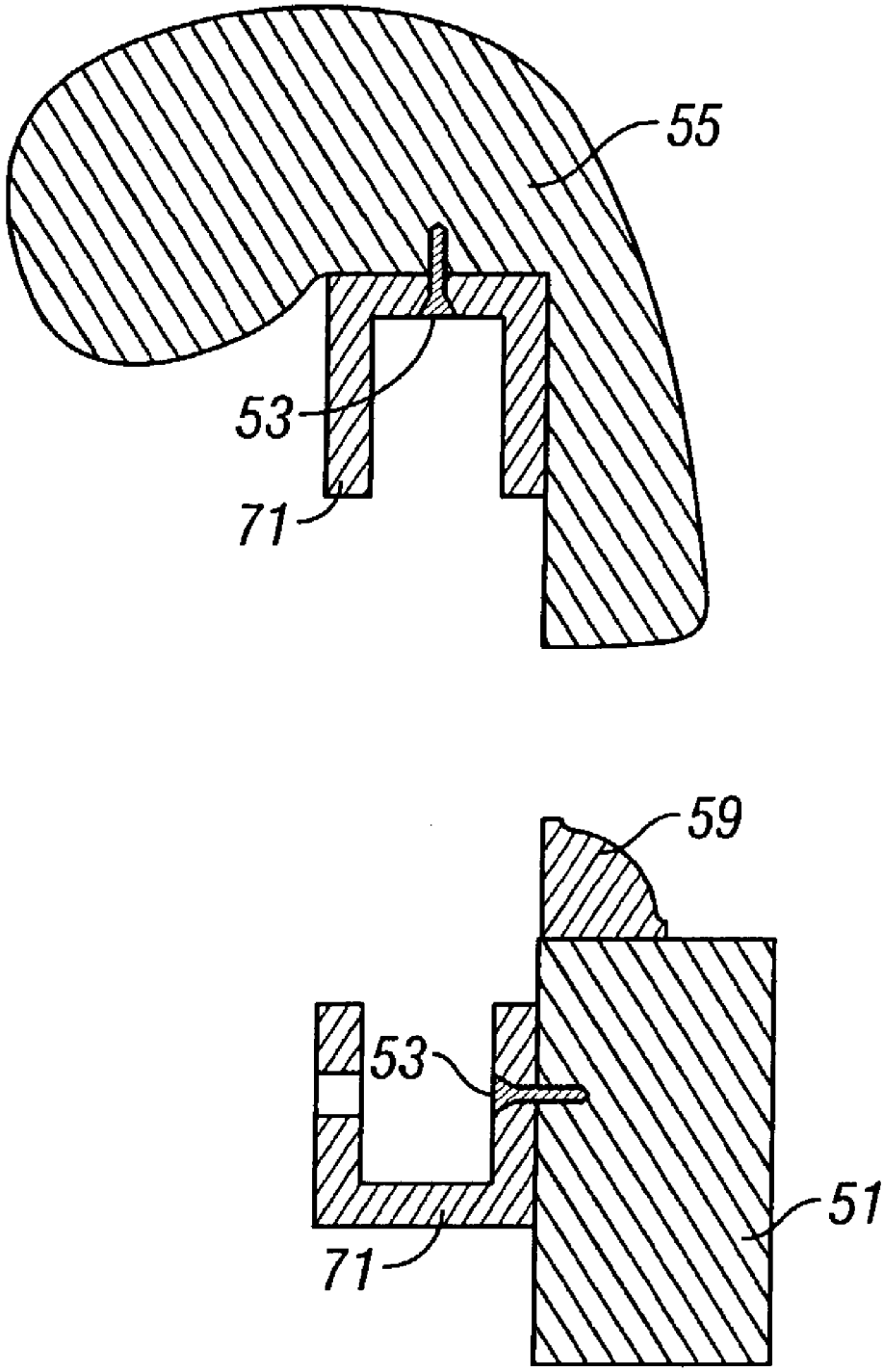
FIG. 9 is a sectional view of an alternative embodiment of the present invention.

An alternative embodiment of the interchangeable furniture system 21 is illustrated in FIG. 9. Instead of channels 41 and angle iron 43 for supporting the interchangeable furniture element 23, U-shaped channel sections are provided for attachment to the mattress rail 51 and the cap rail 55. The U-shaped channels 71 can be attached to the mattress rail 51 and cap rail 55 by use of threaded fasteners 53, or other appropriate arrangement. It should be understood that it is within the scope of the present invention to utilize other channel sections or different mounting arrangements, including spaced wood members, which provide an appropriate lower pocket to receive the lower frame rail 31 and an upper pocket to receive the upper frame rail 33, with sufficient clearance to allow the upper frame rail 33 to move upward during removal of the interchangeable frame element 23. In FIG. 9 the quarter end molding 59 associated with the cap rail 55 has been omitted, along with other elements, for clarity of viewing.

It should be understood that the interchangeable furniture system 21 of the present invention can be utilized in many different types of furniture in addition to headboards. The present invention can also be utilized in case goods, cabinets, commercial displays, and any other furniture product in which it is desirable to quickly, efficiently, and easily change the appearance or function of a surface of the product. For example, the present invention could be utilized in the doors of an armoire for providing interchangeable finished wood faces and upholstered faces, so that the user can selectively change the appearance of the armoire as desired. As noted above, the surface treatments of the faces of the interchangeable furniture element of the present invention are not limited to finished wood and upholstered surfaces, but rather a wide variety of surface treatments may be utilized to provide different appearances to the faces of the interchangeable furniture element for selection as desired. Each face may be upholstered, finished or provided with some other treatment in any combination.

The present invention may also be utilized to provide interchangeable and reversible functional elements for furniture, with, for example, shelving on one face of the interchangeable furniture element 23, and racks on the other face. In this way a furniture product may be easily modified to serve different functions, without requiring costly installation or renovation work.

While the invention has been described with reference to the certain illustrated embodiments, the words which have been used herein are words of description, rather than words of limitation. Changes may be made without departing from the scope and spirit of the invention and its aspects. Although the invention has been described herein with reference to particular structures, acts, and materials, the invention is not to be limited to the particulars disclosed, but rather extends to all equivalent structures, acts, and materials.

What is claimed is:

1. A reversible panel system for a furniture product, comprising:

a furniture product including a frame defining an opening therein, the frame defined by a lower end receiving member, an upper end receiving member, and a pair of side members, the lower and upper end receiving members comprising channels;

a reversible panel constructed and arranged to be releasably received by the frame so as to cover at least a portion of the opening;

wherein the lower end receiving member is constructed and arranged to receive a lower end of the panel and the upper end receiving member is constructed and arranged to receive an upper end of the panel;

wherein the upper end receiving member is sized to allow sufficient space such that sliding movement of the panel toward the upper end receiving member allows the panel to be removed from the frame by a user gripping the lower end of the panel; and wherein the panel is received in the frame of the furniture product by upwardly moving the reversible panel into the channel of the upper end receiving member and subsequently downwardly moving the reversible panel into the channel of the lower end receiving member.

2. The reversible panel system of claim 1, wherein the reversible panel includes a first panel face with a first decorative aspect and a second panel face with a second decorative aspect.

3. The reversible panel system of claim 2, wherein when the reversible panel is received in the frame of the furniture product, one of said first and second panel faces substantially covers the opening.

4. The reversible panel system of claim 1, wherein the panel may be received in the frame such that either the first or second panel faces covers the opening of the frame in a desired direction.

5. The reversible panel system of claim 1, wherein the furniture product is a headboard for a bed.

6. The reversible panel system of claim 1, wherein the upper end receiving member is a channel defined by an angle iron.

7. An interchangeable furniture system for a furniture product, comprising:

a furniture product including a frame defining an opening, the frame defined by a lower end receiving member, an upper end receiving member, and a pair of side members;

an interchangeable furniture element having a lower end, an upper end, and a first surface, the first surface being sized so that when the interchangeable furniture element is in a frame-engaging position, the first surface extends across the opening;

wherein the lower end receiving member comprises a channel for selectively receiving the lower end of the interchangeable furniture element in the frame engaging position, wherein the upper end receiving member comprises a channel for selectively receiving the upper end of the interchangeable furniture element in the frame engaging position; the upper end receiving member being sized to accommodate sufficient upward movement of the interchangeable furniture element to permit the lower end to be positioned over the channel of the lower end receiving member and thereby removed from the lower end receiving member;

wherein the panel is received in the frame of the furniture product by upwardly moving the reversible panel into the channel of the upper end receiving member and subsequently downwardly moving the reversible panel into the channel of the lower end receiving member; and whereby the interchangeable furniture element can be selectively placed in the frame-engaging position and removed therefrom.

8. The interchangeable furniture system of claim 7, wherein the interchangeable furniture element further includes a second surface; the interchangeable furniture element being selectively positionable in a first frame-engaging position so that the first surface extends across the opening, or a second frame-engaging position so that the second surface extends across the opening.

9. The interchangeable furniture system of claim 7, wherein the furniture product is a headboard for a bed.

10. The interchangeable furniture system of claim 7, wherein the upper end receiving member is a channel defined by an angle iron.

11. A method for changing the decorative appearance of a furniture panel including a reversible decorative panel having at least two decorative aspects, the reversible decorative panel being removably supported within a frame in the furniture panel such that at least one of the at least two decorative aspects is visible in a desired direction, comprising:

removing the decorative panel at least partially from the frame, wherein the frame is defined by a lower end receiving member, an upper end receiving member, and a pair of side members, the lower and upper end receiving members comprising channels, the upper end receiving member being sized to accommodate sufficient upward movement of the interchangeable furniture element to permit the lower end to be positioned over the channel of the lower end receiving member and thereby removed from the lower end receiving member, re-orienting the panel with respect to the frame such that a different decorative aspect of the decorative panel is visible from the desired direction; and replacing the panel in the frame of the furniture product by upwardly moving the reversible panel into the channel of the upper end receiving member and subsequently downwardly moving the reversible panel into the channel of the lower end receiving member.

* * * * *